United States Patent [19]

Allen, III

[11] 4,220,147

[45] Sep. 2, 1980

[54] PARTIALLY DISASSEMBLABLE TRACTION SLING

[76] Inventor: Ralph S. Allen, III, 30003 Arena Dr., Evergreen, Colo. 80439

[21] Appl. No.: 857,788

[22] Filed: Dec. 5, 1977

[51] Int. Cl.[2] ..... A61H 1/02

[52] U.S. Cl. ..... 128/75; 128/84 C; 128/87 B

[58] Field of Search ..... 128/76 R, 69, 71, 75, 128/84 C, 84 R, 87 B, 87 R, 72, 73, 74

[56] References Cited

U.S. PATENT DOCUMENTS

| | | | |
|---|---|---|---|
| 761,504 | 5/1904 | Kleinbach | 128/75 |
| 913,127 | 2/1909 | Haas | 128/75 |
| 1,280,987 | 10/1918 | Gregory | 128/71 |
| 1,803,556 | 5/1931 | Nugent | 128/87 B |
| 2,692,595 | 10/1954 | Blair, Jr. | 128/87 B |
| 2,843,114 | 7/1958 | Hall | 128/75 |
| 2,949,152 | 8/1960 | Hipps et al. | 128/75 |
| 3,063,445 | 11/1962 | Ries | 128/75 |
| 3,359,976 | 12/1967 | Laval | 128/75 |
| 3,469,268 | 9/1969 | Phillips | 128/87 R |
| 3,621,839 | 11/1971 | Barthe | 128/75 |
| 3,662,750 | 5/1972 | Jorgensen | 128/84 C |
| 3,915,161 | 10/1975 | Shields | 128/84 C |

FOREIGN PATENT DOCUMENTS

| | | | |
|---|---|---|---|
| 359835 | 3/1962 | Switzerland | 128/71 |

*Primary Examiner*—William E. Kamm
*Assistant Examiner*—Arthur S. Rose
*Attorney, Agent, or Firm*—John E. Reilly

[57] ABSTRACT

Traction sling apparatus is adapted for applying a tensile force on a person's neck and spine for infield use. The traction sling includes a chin strap and a neck strap loosely attached together in spaced-apart relation to each other, one end of each strap being detachable from the corresponding end of the other strap to partially disassemble the apparatus facilitating positioning of the sling under the person's head. A leader device is provided for temporary attachment to the detached end of one of the straps for pulling the sling into position under the person's head. The invention also includes an anchor device in the form of a frame detachably connected to the back of a spine board on which the person is laid, and it includes adjustable means for applying tension to the traction sling and to the person's neck and spine.

9 Claims, 8 Drawing Figures

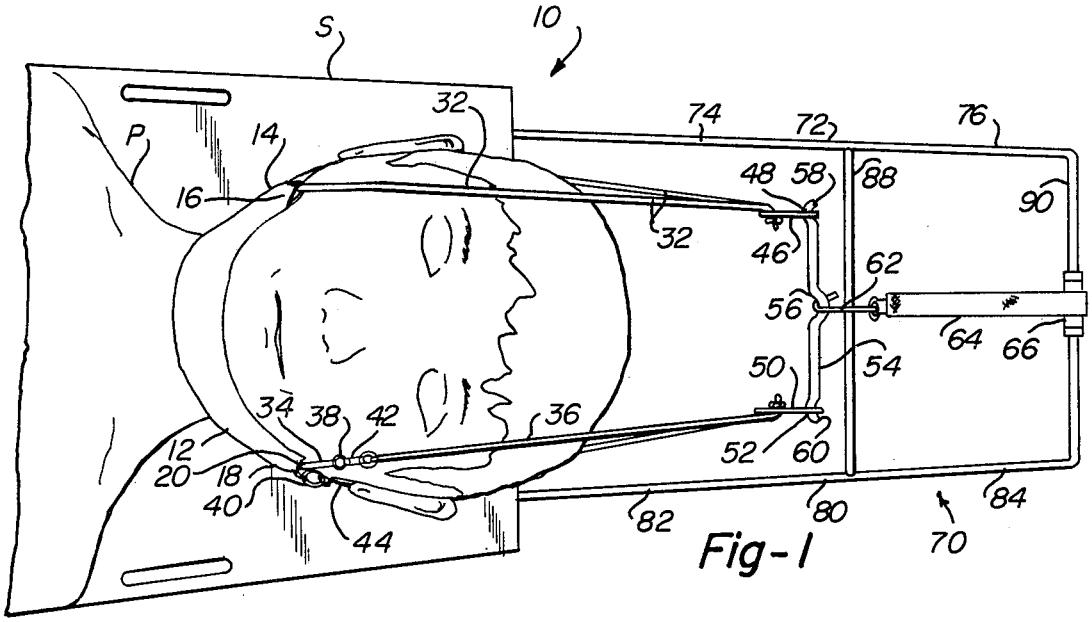
Fig-1
Fig-2
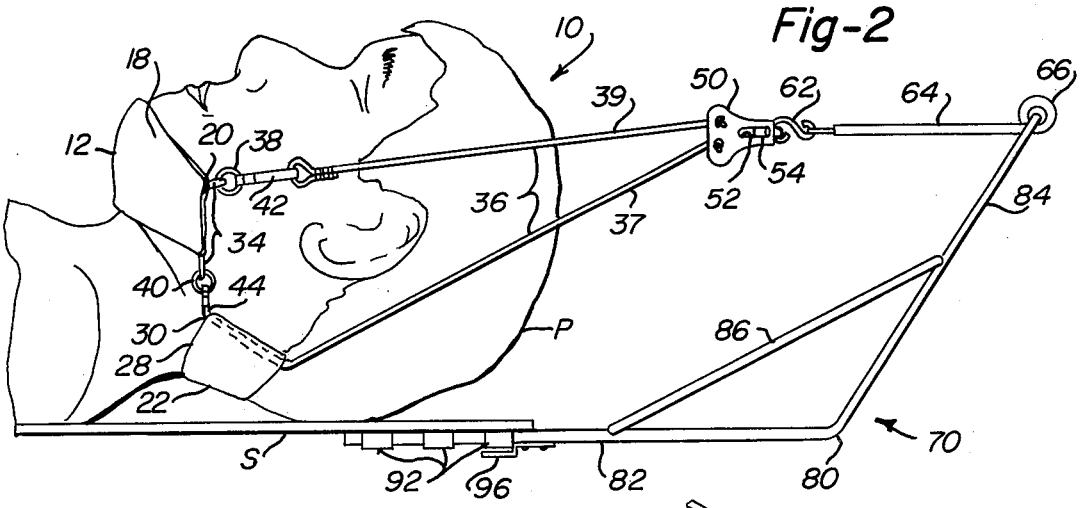
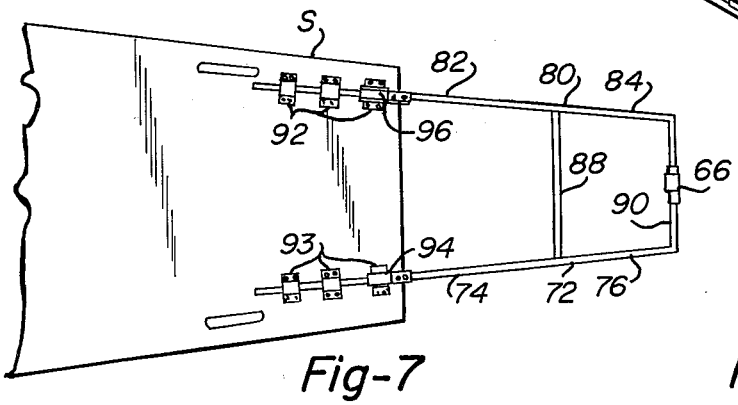
Fig-7
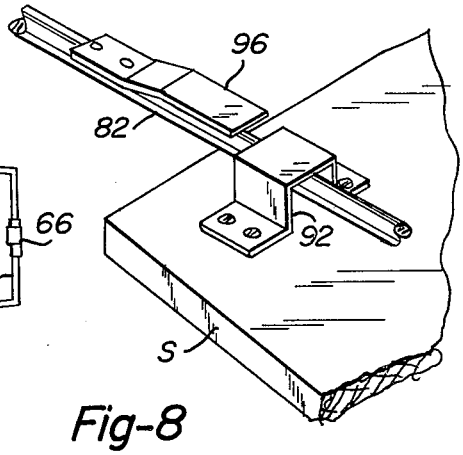
Fig-8

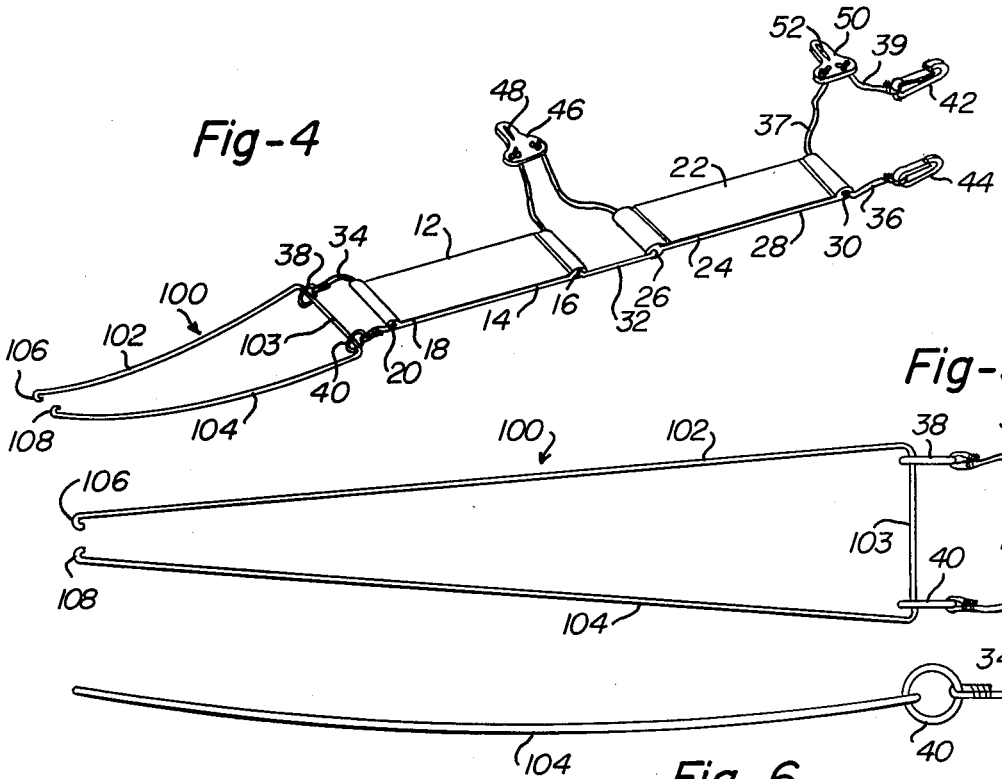
Fig-4
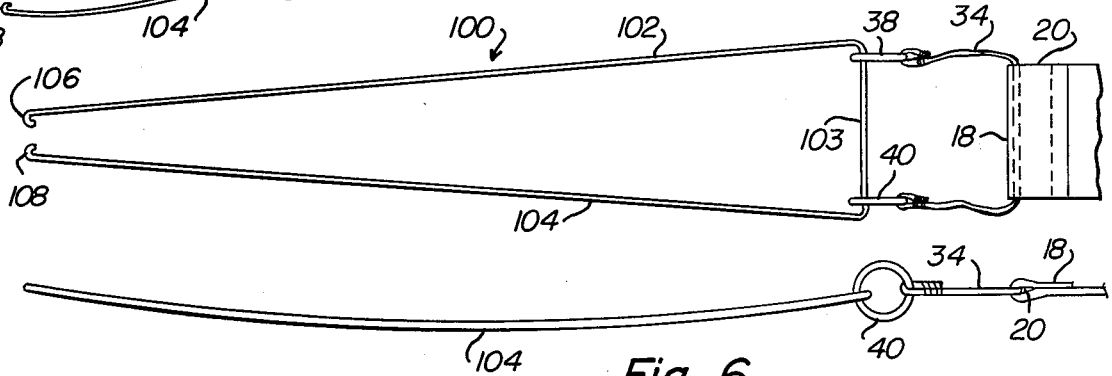
Fig-5
Fig-6
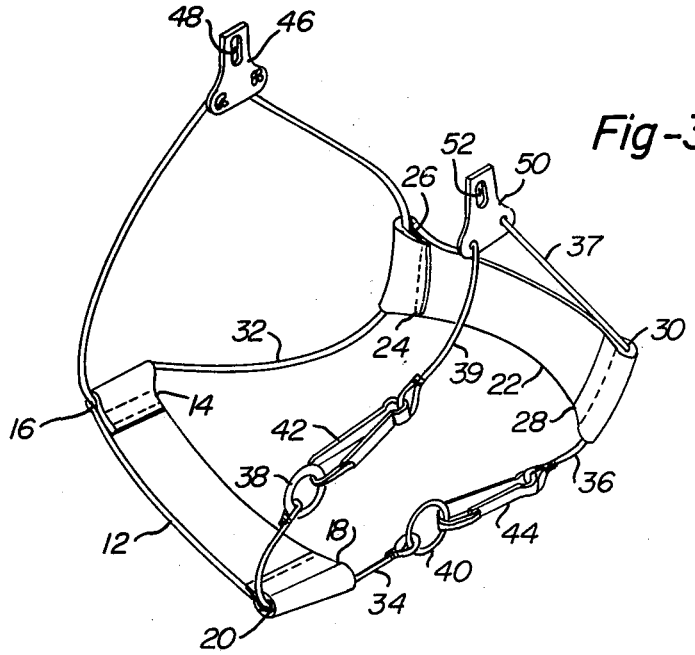
Fig-3

PARTIALLY DISASSEMBLABLE TRACTION SLING

BACKGROUND OF THE INVENTION

The present invention relates generally to orthopedic devices, and more specifically to a portable traction device for applying the tensile stress on a person's neck and spine.

Traction devices for applying a prolonged pulling or tensile stress on muscles, organs, bones, or the like, to correct dislocation, relieve pressure, and other therapeutic purposes have been in general use for a long time. It is common for such traction to be applied under a person's head to treat cervical or spinal fractures by applying a longitudinal force to the person's head directed away from his body resulting in a tensile stress on his back and spine. Conventional apparatus for applying such traction includes a strap or pad placed under the person's jaw or chin and another strap or pad placed under the back of his head near his neck, with means for applying a longitudinal force on those pads tending to pull the head in a longitudinal direction away from the body. However, these devices are not always easy to position under the person's head, particularly while the person is lying in a supine position, without unduly disturbing the position of his head during application which could cause severe pain or additional injury to his cervix or spine. This problem is further complicated in circumstances such as emergency rescue or first aid where completely adequate facilities or adequate numbers of personnel may not be available to assist in positioning the traction device under the patient's head. This problem is further compounded in such emergency circumstances when the attending medic or other person may be attending to several matters simultaneously and might have only one hand available or free to manipulate the traction device into proper position.

SUMMARY OF THE INVENTION

Accordingly, it is an object of the present invention to provide portable traction apparatus for providing traction to the cervix or spine that can be partially disassembled for positioning under a person's head and then conveniently reassembled without unduly disturbing the position of the patient.

It is another object of the present invention to provide a leader means for detachably connecting to partially disassembled traction sling to assist in pulling the sling into position under the patient's head without unduly disturbing him.

Another object of the present invention is to provide portable traction apparatus including an anchoring device removably attached to the backside of a spine board and also including adjustable suspension means for applying a tensile force to the patient's cervix and spine to release pressure and to inhibit movement of the head in relation to the cervix and spine to prevent further injury during movement and transportation of the patient.

The present invention includes traction sling apparatus for applying a tensile force to the cervix and spine of a patient by applying a force to the bottom of the patient's head in a direction longitudinally away from the rest of the body, which apparatus can be partially disassembled to facilitate proper positioning of the apparatus on the patient and then can be conveniently reassembled, even by use of only one hand if that is necessary under the circumstances. It includes two flexible straps, one for positioning under the patient's jaws or chin, and the other for positioning under the back of his head behind his neck, both of which straps are loosely attached together in spaced-apart relation to each other by flexible cords running through their common ends. These cords are releasably connected to an adjustable force-applying means on an anchoring device.

The flexible cords which loosely connect one end of the chin strap to the corresponding end of the head strap includes releasable connecting means so that said one end of the chin strap can be temporarily disconnected from the corresponding end of the head strap while the traction sling is placed into position under the patient's head, whereupon the cords can be reconnected before applying the traction force.

A leader device is also provided which can be temporarily attached to the free end of the chin strap when it is disconnected from the corresponding end of the head strap for pulling the chin strap and a portion of the head strap under the patient's head between his neck and the spine board on which he is lying. This leader device, in combination with the partially disassembled traction sling allows the positioning of the traction sling properly under the patient's head without unduly moving or disturbing his head, and it facilitates manipulation of the traction sling into proper position with only one hand in circumstances where that is necessary.

As mentioned above, the anchor device comprises a frame member which is detachably connected to the rear side of the forward end of the spine board on which the patient is lying, and it protrudes forwardly and upwardly into approximate longitudinal alignment with the patient's body. It is provided with an adjustable belt releasably connected to the flexible cords of the traction sling. One end of the belt is attached to a hand ratchet mounted on the distal end of the frame member of the anchoring device for drawing the belt and cords tight in applying longitudinal force under the patient's head directed away from his body to provide traction to the cervix and spine.

BRIEF DESCRIPTION OF THE DRAWINGS

Other objects, advantages and capabilities of the present invention will become more apparent as the description proceeds, taken in conjunction with the accompanying drawings, in which:

FIG. 1 is a plan view of the traction sling of the present invention positioned on a patient lying on the spine board;

FIG. 2 is a side elevation of the traction sling positioned on a patient who is lying on a spine board;

FIG. 3 is a perspective view of the traction sling in assembled configuration, not including the anchoring device;

FIG. 4 is a perspective view of the traction sling disassembled and including the leader device temporarily connected thereto;

FIG. 5 is an enlarged plan view of the leader device temporarily attached to the free end of the chin strap;

FIG. 6 is an elevation view of the leader device shown in FIG. 5;

FIG. 7 is a plan view of the back side of the anchoring device removably attached to the back side of the spine board; and FIG. 8 is an enlarged, perspective view of one leg of the anchoring device frame in nearly assembled relation to a corner of the back side of the spine board.

DETAILED DESCRIPTION OF THE PREFERRED EMBODIMENT

The traction apparatus 10 of the present invention is seen in FIGS. 1 and 2 properly positioned under the head of a patient P who is lying on his back on a spine board S. The sling has two relatively wide, elongated flexible straps 12, 22 in spaced-apart relation to each other, the first strap 12, hereinafter referred to as chin strap, being positioned under the patient's chin, and the second strap 22, hereinafter referred to as head strap, positioned under the back of the patient's head just behind his neck. The chin strap 12 and head strap 22 are connected at their ends to an anchoring device 70 by cords extending from the ends of the straps 12, 22 alongside the patient's head to the anchoring device 70.

Referring now to FIG. 3 for a more detailed description of the sling, one end 14 of the chin strap 12 is folded to return upon itself and is permanently fastened in such position, e.g., as by sewing or adhesive, to form a transverse casing 16. The opposite end 18 of chin strap 12 is similarly folded and returned upon itself and fastened in that position to form a transverse casing 20 at that end. In like manner, the end 24 of head strap 22 is folded and returned upon itself and fastened in that position to form a transverse casing 26, and its opposite end 28 is also folded and returned upon itself to form a transverse casing 30. A flexible cord 32 extends through casing 16 at one end 14 of chin strap 12 and through casing 26 at one end 24 of the head strap 22, and each end of cord 32 is permanently fastened to an ear 46, such that the respective ends, 14, 24 of chin strap 12 and head strap 22 are loosely but permanently connected together by flexible cord 32.

At the opposite end 18 of chin strap 12, a relatively short flexible cord in the form of a first loop portion 34 extends through casing 20, each end of said cord 34 terminating in a ring 38, 40, respectively, said ring being permanently affixed thereto. Another flexible cord in the form of a second loop portion 36, comprised of two segments 37, 39 extends through casing 30 in end 28 of head strap 22. A releasable hook 44 is permanently affixed to one end of segment 37, and a similar releasable hook 42 is permanently affixed to one end of segment 39. The opposite ends of each segment 37, 39 are permanently affixed to an ear 50, which is similar to the ear 46. Hook 44 is adapted for releasable connection to ring 40, and hook 42 is similarly adapted for releasable connection to ring 38. The combined length of cord 34 and segments 37, 39 of cord 36 are approximately equal to the length of cord 32. By referring again to FIGS. 1 and 2, the traction sling illustrated in FIG. 3 can be seen properly positioned under the head of a patient P when the apparatus is fully assembled.

In circumstances such as emergency rescue and first aid where a person may have a fractured cervix or spine, it is sometimes desirable to place the person's cervix or spine in traction while he is being moved to the hospital to prevent undue movement of his head in relation to his body to prevent discomfort or further injury. In such circumstances, available personnel and equipment may be limited, and movement of the person, including his head or neck should be kept to an absolute minimum. In such circumstances, positioning the conventional traction apparatus on a person's head, without undue movement or discomfort to the person, may be quite difficult, especially when the attending medic may have only one hand available due to perhaps the requirement to attend other equipment or to support or steady the person. Consequently, the portable traction sling of this invention has been devised to facilitate convenient, even one-handed, manipulation of the sling into proper position under the person's neck as he is lying on a spine board.

Description of this feature is best accomplished by reference to FIGS. 4, 5 and 6, wherein the traction sling is partially disassembled by detaching hook 42 from ring 38 and detaching hook 44 from ring 40. With the hooks 42, 44 unattached in this manner, the traction sling can be laid out in substantially flat, spread-out position as shown in FIG. 4. A leader device 100 is temporarily attached to the free end 18 of chin strap 12. This leader device 100 can be inserted under the person's head between his neck and the spine board on which he is lying from one side so that it protrudes out under the opposite side of his head. The forward ends 106, 108 of the leader device 100 can then be grasped and pulled the remainder of the way under the patient's lower head and neck drawing with it the chin strap 12 and the head strap 22 until the head 22 is positioned approximately behind the person's head directly behind his neck. The leader device 100 is then detached from the traction sling, and the traction sling is reassembled by rotating the chin strap 12 to a position under the person's chin and jaws. The hook 32 is reconnected to ring 38 and hook 44 is reconnected to ring 40. In this manner, the traction sling can be properly positioned under the person's head without undue movement of his head which could cause severe pain or other injury.

Of course, the sling could function if it is only equipped with one side of releasable hook and ring on the ends to accommodate this partial disassembly for positioning on the patient; but the requirement of having to re-thread the cord through the casement on one end of a strap would be more inconvenient and time-consuming than this preferred embodiment.

The leader device 100 is preferably fabricated of a rigid, elongated rod formed in the shape of an elongated stirrup having two spaced-apart elongated side members 101, 104, each of which extends forwardly from opposite ends of a transverse cross-section 103. The leader device 100 can then be temporarily attached to the free end 18 of the chin strap 12 by inserting it through the rings 38, 40, respectively, to a position where the rings are engaged with the cross-portion 103 adjacent respective side portions 102, 104, respectively. As shown in FIG. 6, the side members 102, 104 are slightly bowed or curved into a slightly concave configuration to facilitate convenient insertion of the device under the person's neck from one side of his head and grasping of the forward end of the device at the other side. The ends 106, 108 of side portions 102, 104, respectively, are bent to return inwardly as shown in FIGS. 4 and 5 to eliminate any sharpness that may cause discomfort or catch on clothing, sheets, etc., and to facilitate grasping of the leading ends when they have been inserted under the person's neck to pull the sling through the opposite side.

As mentioned above, the portable traction sling apparatus 10 of this invention includes an anchor device as best seen in FIGS. 1, 2, 7, and 8. The anchoring device includes a rigid frame 70 comprised of two substantially parallel, spaced-apart legs 72, 80 removably attached to and extending forwardly of the rear side of the front end of the spine board S, as shown by portions 74, 82 of legs 72, 80, respectively. The legs 72, 80 then bend upwardly into portions 76, 84 respectively, and terminate in a common cross-member 90 extending transversely therebetween and positioned in approximate longitudinal alignment with the patient's body as he is lying on the spine board S. The frame 70 includes corner braces 86 and a center cross-member 88 to enhance the structural rigidity and strength of the frame member.

A flexible belt 64 is adjustably mounted on the cross bar 90 with a hand ratchet 66. A hook 62 on the distal end of belt 64 supports a transverse yoke 54. The ears 46, 50 attached to cords 32, 36 of the traction apparatus are removably mounted on opposite ends of the yoke 54 by inserting said opposite ends through holes 48, 52 in ears 46, 50, respectively. The yoke is provided with a center bend 56 and end bends 58, 60 to maintain the spacing relationships between the hooks 62 and ears 46, 50 as tension is applied. When so assembled, the belt 64 is tightened to apply traction or tensile stress to the person's cervix and spine by turning the hand ratchet 66 which rotates in one direction but resists rotation in the reverse direction.

The legs 72, 80 are releasably attached to the back side of spine board S by inserting their lower portions 74, 82, respectively, into U-shaped brackets 92, 93 on the back of spine board S, as shown in FIGS. 7 and 8. The clips 94, 96 mounted at approximately mid-length of leg portions 74, 82, respectively, limit the amount which the legs can be inserted into the U-shaped brackets and restrain the frame 70 against longitudinal movement when tensile force is applied to the traction apparatus.

Although there is a wide variation of suitable materials from which the parts of this portable traction sling can be fabricated, the chin strap and head strap can be fabricated of brushed cotton or plastic-coated fabric and can be disposable. The rings, hooks, ears, and yoke are preferably metal, but they can be fabricated of a strong plastic. The frame 70 should be a strong, rigid steel alloy which can resist the traction forces without substantial deflection or strain, and the leader device can be fabricated of either a rigid plastic or steel. It should also be mentioned that while the traction sling of this invention is especially well suited for portable, in-field use, it can be used with equal convenience and utility in hospitals, nursing homes, and the like.

Although the present invention has been described with a certain degree of particularity, it is understood that the present disclosure has been made by way of example and that changes in details of structure can be made without departing from the spirit thereof.

What is claimed is:

1. Traction sling apparatus, comprising:

two wide, elongated flexible straps, each said strap having a first end and a second end, the first of said straps being permanently but loosely fastened together with the second of said straps in roughly parallel spaced-apart relation to each other by a first flexible cord slidably attached to said first ends of said straps;

a pair of rings attached to opposite lateral sides of said second end of said first strap, and a pair of releasable hook means loosely attached to opposite lateral sides of said second end of said second strap, said hook means being adaptable for releasable engagement with said rings; and hanger means connected to said first and second ends of said straps for suspending said straps from an anchoring device.

2. The traction sling apparatus of claim 1, including leader means adapted for detachable connection to said second end of said first strap for drawing the traction apparatus between a patient's neck and an object on which he is lying to place said second strap in a position under the back of the patient's head without unduly disturbing the patient.

3. The traction sling apparatus of claim 2, wherein said leader means is a rigid, small diameter rod formed in the general shape of an elongated stirrup having two elongated side members extending forward from the ends of a substantially straight, transverse end member, the length of said end member approximately corresponding to the width of said straps, said rod being adapted to insertion through said rings to a position where said rings are placed around opposite ends of said end member adjacent respective side members for drawing said straps under the patient's neck into proper position.

4. The traction sling apparatus of claim 3, wherein each of said straps has a portion on each end folded back upon itself to form a transverse casing at each end, said first flexible cord passing through the casings in said first ends of said straps and including a second cord extending through the casing in the second end of said first strap, each of said rings respectively being permanently connected to opposite ends of said second cord, and a third cord extending through the casing in the second end of said second strap, each of said hook means respectively being permanently connected to opposite ends of said third cord, said hanger means including a pair of ears, each of which respectively is attached to said first and third cords.

5. The traction sling apparatus of claim 4, including an anchoring device comprising a rigid frame adapted for removable attachment to the back side of a spine board and for extending outwardly from the front end of a spine board then upwardly to a distal end positioned forward and above the top surface of a spine board, a flexible belt attached to and extending rearwardly from said distal end of said frame and terminating in a hook connected to a transverse yoke, said ears respectively being removably attachable to opposite ends of said yoke, and including rotatable hand ratchet winding means on said distal end of said frame for adjustably applying a tensile force to said belt and said hanger means to apply traction to a person's head when lying on a spine board with the traction apparatus positioned with said first strap under his chin and said second strap under the back of his head.

6. Traction sling apparatus for applying a tensile force to a person's cervix and spine, comprising:

a first elongated flexible strap adapted for positioning under the person's chin and lower jaw, and a second elongated flexible strap adapted for positioning under the back of the person's head behind his neck, each of said straps having a first end and a second end;

a first flexible cord in the form of a loop which is attached to the first end of said first strap and to the first end of said second strap to loosely attach said first ends of said first and second straps together in spaced-apart relation to each other;

a second flexible cord in the form of a first loop portion which is slidably attached to the second end of said first strap and a second loop portion slidably attached to the second end of said second strap, releasable connection means for releasably connecting said first and second loop portions together whereby to loosely attach said second ends of said first and second straps together in spaced-apart relation to one another, said releasable connection means including a first releasable fastener positioned between said loop portions in said second cord on one side of said first strap, and a second releasable fastener positioned between said loop portions in said second cord on the opposite side of said first strap; and leader means adapted to be detachably connected to said second end of said second strap for drawing said second strap under the person's head behind the neck when said first and second loop portions are disconnected.

7. The traction sling apparatus of claim 6, wherein said first releasable fastener includes a first releasable hook and a corresponding first ring to which said first hook can be connected, and said second releasable fastener includes a second releasable hook and a corresponding second ring to which said second hook can be connected.

8. The traction sling apparatus of claim 7, wherein said first cord is slidably attached to said first ends of said first and second straps, said second cord is slidably attached to said second ends of said first and second straps, said second end of said first strap being slidably attached to a segregated portion of said second cord, said first ring being affixed to one end of said segregated portion on one side of said first strap, said second ring being affixed to the opposite end of said segregated portion on the opposite side of said first strap, and said first and second hooks being affixed to corresponding opposite ends of the remaining portion of said second cord.

9. The traction sling apparatus of claim 6, wherein said leader means includes a narrow elongated device which is attachable to said releasable connection means when disconnected for pulling the partially disassembled sling into position under the person's head and is then detachable from said releasable connection means so said connection means can be reconnected to reassemble the sling for use in applying traction.

* * * * *